US007032750B2

(12) United States Patent
Amtenbrink

(10) Patent No.: US 7,032,750 B2
(45) Date of Patent: Apr. 25, 2006

(54) STORAGE DEVICE FOR ONE OR MORE TOOLS

(75) Inventor: Klaus Amtenbrink, Wuppertal (DE)

(73) Assignee: Wera Werk Hermann Werner GmbH & Co. KG, Wuppertal (DE)

( * ) Notice: Subject to any disclaimer, the term of this patent is extended or adjusted under 35 U.S.C. 154(b) by 0 days.

(21) Appl. No.: 10/466,755

(22) PCT Filed: Dec. 22, 2001

(86) PCT No.: PCT/EP01/15300

§ 371 (c)(1),
(2), (4) Date: Dec. 22, 2003

(87) PCT Pub. No.: WO02/057055

PCT Pub. Date: Jul. 25, 2002

(65) Prior Publication Data

US 2004/0084341 A1 May 6, 2004

(30) Foreign Application Priority Data

Jan. 19, 2001 (DE) ..... 101 02 251
Nov. 16, 2001 (DE) ..... 101 56 459

(51) Int. Cl.
*B65D 85/28* (2006.01)

(52) U.S. Cl. ..... 206/379; 206/779

(58) Field of Classification Search ..... 206/349, 206/379, 742, 743, 751, 754, 755, 779; 211/69, 211/70.6
See application file for complete search history.

(56) References Cited

U.S. PATENT DOCUMENTS 3,544,007 A * 12/1970 Bordman ..... 239/60
4,416,372 A * 11/1983 Polk ..... 206/372
4,619,364 A * 10/1986 Czopor, Jr. ..... 206/379
4,759,935 A * 7/1988 Toshitsugu ..... 426/110
4,899,877 A * 2/1990 Kiernan ..... 206/349
D320,934 S * 10/1991 Cross et al. ..... D9/415
5,429,235 A * 7/1995 Chen ..... 206/373
5,566,828 A * 10/1996 Claes et al. ..... 206/570
D399,652 S * 10/1998 Fang ..... D3/282
5,918,741 A 7/1999 Vasudeva (Continued)

FOREIGN PATENT DOCUMENTS

DE 29719309 3/1999

(Continued)

*Primary Examiner*—David T. Fidei
(74) *Attorney, Agent, or Firm*—Martin A. Farber

(57) ABSTRACT

Storage device for at least one tool, in particular a screwing tool such as a screwdriver (1) or chuck (2) with exchangeable screwdriver inserts (3), having a base part (4) and a pivot-open lid part (5) articulated thereon, a mount (6, 7, 24) being provided for accommodating the tool (1, 2) in a fixed position in a plane in which the base part and/or lid part (5) extend/extends, and the lid part (5) having a window (8) which is similar to an outline contour of the tool (1, 2) and the peripheral-edge spacing of which is selected such that the tool (1, 2) cannot be removed through the window (8) of a closed said lid part (5). Certain regions of the tool (1, 2) accommodated by the mount (6, 7, 24) project through the window (8) of the closed lid part (5), peripheral portions of the window being in contact, or nearly in contact, with at least two positions on the tool.

20 Claims, 14 Drawing Sheets

U.S. PATENT DOCUMENTS

| | | | | |
|---|---|---|---|---|
| 6,105,767 | A * | 8/2000 | Vasudeva | 206/372 |
| 6,105,770 | A * | 8/2000 | Vasudeva | 206/378 |
| 6,267,238 | B1 * | 7/2001 | Miller et al. | 206/349 |
| 6,626,295 | B1 * | 9/2003 | Vasudeva | 206/373 |

FOREIGN PATENT DOCUMENTS

| | | |
|---|---|---|
| DE | 29902062 | 12/1999 |
| DE | 20106966 | 7/2001 |

* cited by examiner

Fig. 4
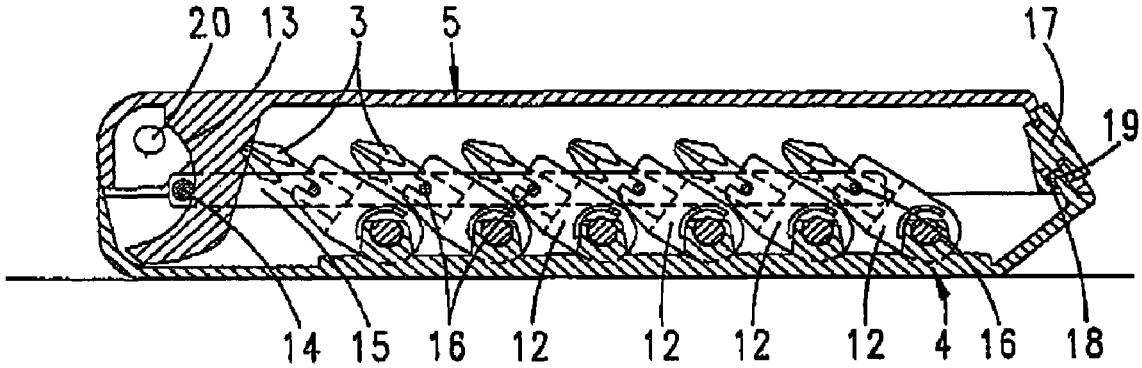
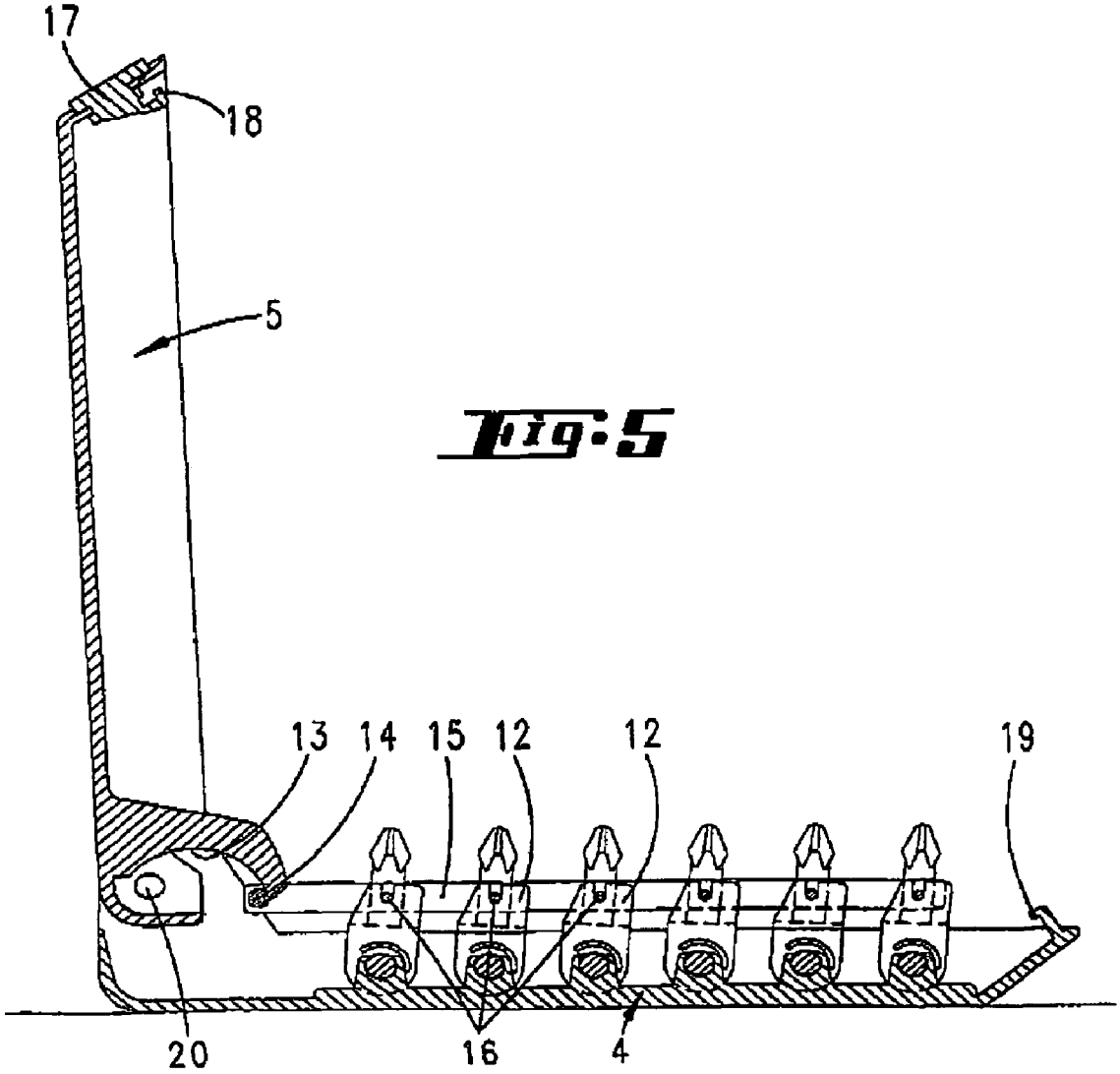
Fig. 5

17
18
5
8
2
6
23
11
13
19
20
14
15
4
10

17
18
5
8
13
9
1
21
20
7
7
7
4
19

STORAGE DEVICE FOR ONE OR MORE TOOLS

FIELD AND BACKGROUND OF THE INVENTION

The invention relates to a storage device for one or more tools, in particular screwing tools such as screwdrivers or chucks with exchangeable screwdriver bits, having a base part and a pivot-open lid part articulated thereon, a mount being provided for accommodating the tool in a fixed position in the plane in which the base part extends, and the lid part having a window which is similar to the outline contour of the tool and the peripheral-edge spacing of which is selected such that the tool cannot be removed through the window of the closed lid part.

Such a storage device is known from DE 297 19 309 U1.

There, the tool is located beneath a window which has its peripheral edge following the outline contour of the tool. The spacing between two peripheral edges of the window which are directed toward one another is kept small enough to prevent the tool from falling through the window if the device is upended.

SUMMARY OF THE INVENTION

It is an object of the invention to develop the known storage device in a functionally advantageous manner.

Accordingly the invention provides, first and foremost, that certain regions of the tool accommodated by the mount project through the window of the closed lid part, the peripheral portions being in contact, or in virtual contact, with at least two portions of the tool. As a result of this configuration, it is possible for the overall height of the storage device to be reduced to a considerable extent. The tool located therein may be thicker, and in particular have a larger diameter, than the overall height of the storage device. Along with this advantage, the contact of the peripheral-edge portions with the tool and, in particular, with the projecting portion of the same is accompanied by largely rattle-free mounting of the tool in the storage device. In the case of preferred contact, the freedom from rattling is also optimized. A further advantage is that it is possible to touch the projecting portion of the tool. This may be more or less the entire axial length of the tool, so that it is possible not just to see the outer contour of the tool from the outside, but also to touch the same, without reaching through the window. In this respect, the storage device also performs a sale-inducing function. The customer does not have to open the storage device in order to be able to look at, and in particular to touch, the tool located therein. At the same time, the peripheral contact ensures that the tool cannot be removed from the closed accommodating device. In a development of the invention, it is provided that the entire projecting portion is held by the peripheral portion such that it is in contact therewith or is only spaced apart therefrom to a slight extent. In the case of this variant, the contour line of the window periphery follows the contour line of the projecting portion. This makes it possible for the tool to be held in a largely gap-free manner. This has the advantage that it is not possible for small parts either to fall through the window into the closed storage device or out of the same. The tool then closes the window. This is advantageous in particular for use of the storage device on building sites since, with a tool located in the storage device and the storage device closed, it is not possible for any particles of dirt, such as shavings or the like, to enter. It is also possible for the tool, once removed from the storage device, to be laid on the window of the closed lid part. Certain regions of it then project through the window into the interior of the storage device. The window allows the tool to be deposited without the latter rolling away. Here too, it is possible for the window to be closed by the tool. This rolling-prevention means even functions if the storage device is not set down on a horizontal surface. It is also the case that the tool does not roll away if the storage device is located on a slope. In a development of the invention, it is provided that the mount is a tray. As an alternative, it is also possible for the mount to be formed from spaced-apart crosspieces extending from the base. If the mount has been configured as a tray, then it is possible for the lid to rest on the tray periphery or be spaced apart from the tray periphery merely by a small gap. This has the advantage that, even with the tool removed from the device and the lid part closed, it is not possible for any small parts to fall into the storage device or out of the same. In a development of the invention, it is provided that the tray is seated in the lid of a chamber associated with the base part. Located beneath the tool, in the case of this variant, is a storage chamber which can only be opened if the lid part is also opened. This chamber serves for accommodating small parts. Opening the chamber causes the tool which is located in the tray of the chamber lid to be raised at the same time. It is thus also possible for the tool to be removed more conveniently from the tray. At the same time, the chamber lid is subjected to loading by the mass of the tool located in the tray, so that it can close automatically when the tool is located in the tray. The lid part is preferably forced in the opening direction by spring action. As a result, the lid can only be retained in the closed position by means of a closure. If the closure is opened, then the lid springs automatically into the open position. In a development of the invention, it is provided that a multiplicity of pivot-open bars is assigned to the base part. Each of these bars has a multiplicity of insertion openings for screwdriver bits. The individual bars, which are located parallel to one another, may be coupled for movement purposes to a connecting rod. If the lid is closed, then the connecting rod is displaced and the bars pivot from a removal position into a storage position. For this purpose, the lid part may form a hook-like cam which interacts with a drive pin of the connecting rod. If a tool is deposited on the window of the lid part, the lid part cannot open even when the closure has been opened. The weight of the tool is greater than the spring force which forces the lid into the open position. The invention also relates to those storage devices in which the tool is retained with a clamping fit in the window. In the case of this variant, in addition to regions of the window being in contact with a portion of the tool, that is to say in particular a portion of a handle, the tool, that is to say in particular the handle, is retained in the window. Mounting takes place by means of a clamping fit. If the lid part is opened, then the tool remains in the window associated with it and pivots along therewith. In addition to the tool, it is also possible for other, supplementary tools or accessories for the tool to be disposed in the lid part. These articles are also retained with a clamping fit in the lid part. As a result, when the lid is swung open, the articles which are located in the storage device remain in the compartments associated with them. The articles can then be removed from the compartments of the lid part or the compartments of the base part. In order to realize the clamping fit, the region of the lid part and/or base part to which the window is assigned has an increased material thickness. The wall of the window may be produced from an elastic, compliant material, in particular soft plastics material. This window reveal has a contour which corresponds to the contour of the tool, that is to say of the handle in particular, so that this handle, which closes the window with a clamping fit, closes the window opening to the full extent. The contour surface of the reveal may be undercut in order to realize the clamping fit; In particular, this reveal may have a hollow contour. The soft-plastics reveal may be formed by a soft-plastics lining of the lid part. This lining can form further compartments, in which the abovementioned supplementary tools are likewise located with a clamping fit. It is also possible for the base part to have a soft-plastics lining. One of the tools may be a screwdriver handle. The latter projects outward through the window by way of a projecting portion. Another tool may be the head of a pair of pliers. The retaining cutout for this tool may likewise be associated with a window, so that it can be seen from the outside, with the lid closed, as to whether the associated retaining cutout contains the pliers head. The base of the retaining cutout associated with the pliers head here has a viewing window which substantially follows the contour of the pliers head. The viewing window is preferably directed toward the joint of the pliers. Applying pressure from the outside on the joint of the pliers or of the pliers head makes it possible to force the latter out of the retaining cutout. The soft-plastics lining may be fitted in a metal shell which forms the lid. It is even possible here for a large surface area of the soft-plastics lining to be visible from the outside. The opening of the shell is then larger than the window. The base part (4) and lid part (3) can be locked to one another by means of a closure (17).

BRIEF DESCRIPTION OF THE DRAWINGS

Exemplary embodiments of the invention are explained hereinbelow with reference to attached drawings, in which:

FIG. 4 shows a section along line IV—IV in FIG. 3 in the closed position, FIG. 5 shows the sectional illustration according to FIG. 4 in the open position, FIG. 7 shows a second exemplary embodiment of the invention in an illustration according to FIG. 1.

DETAILED DESCRIPTION OF THE PREFERRED EMBODIMENT

The storage device illustrated in FIGS. 1 to 6 serves for accommodating a chuck 2 which can be inserted, by way of a polygonal portion 23, for example into the chuck of an electric screwdriver.

Figure 8:
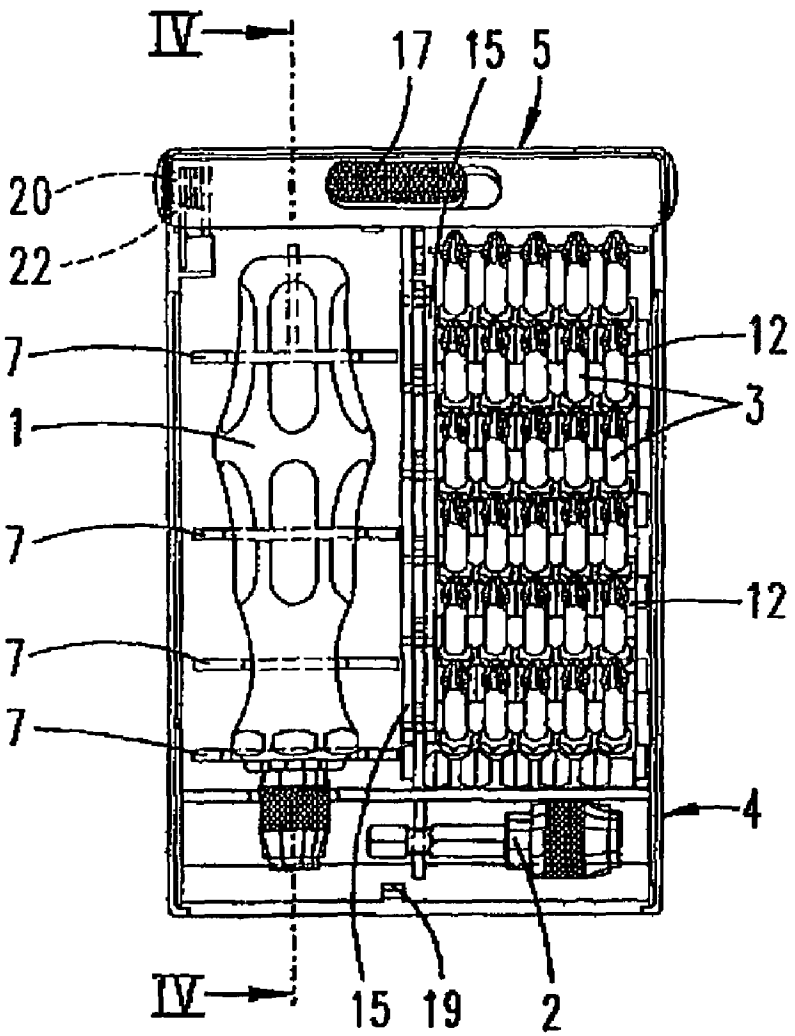
FIG. 8 shows the second exemplary embodiment of the invention in an illustration according to FIG. 2.
Figure 9:
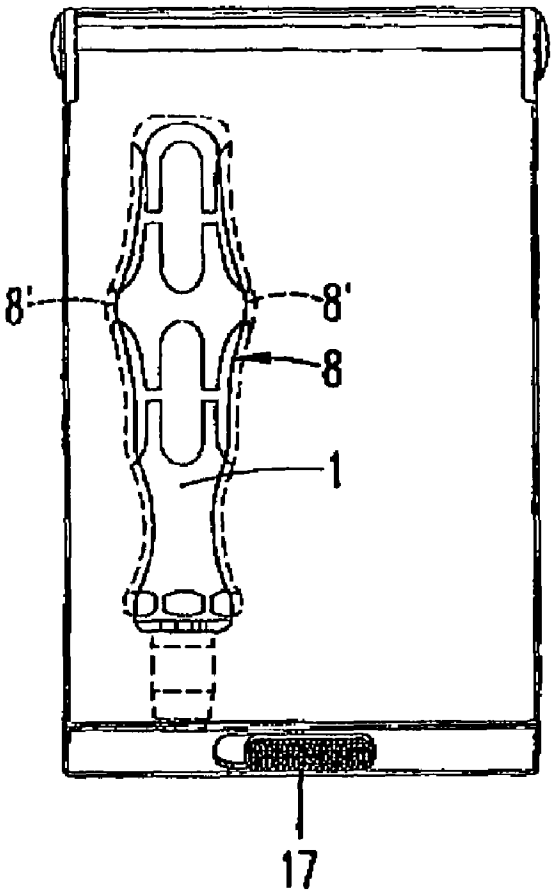
FIG. 9 shows the second exemplary embodiment of the invention in an illustration according to FIG. 6.
Figure 9:
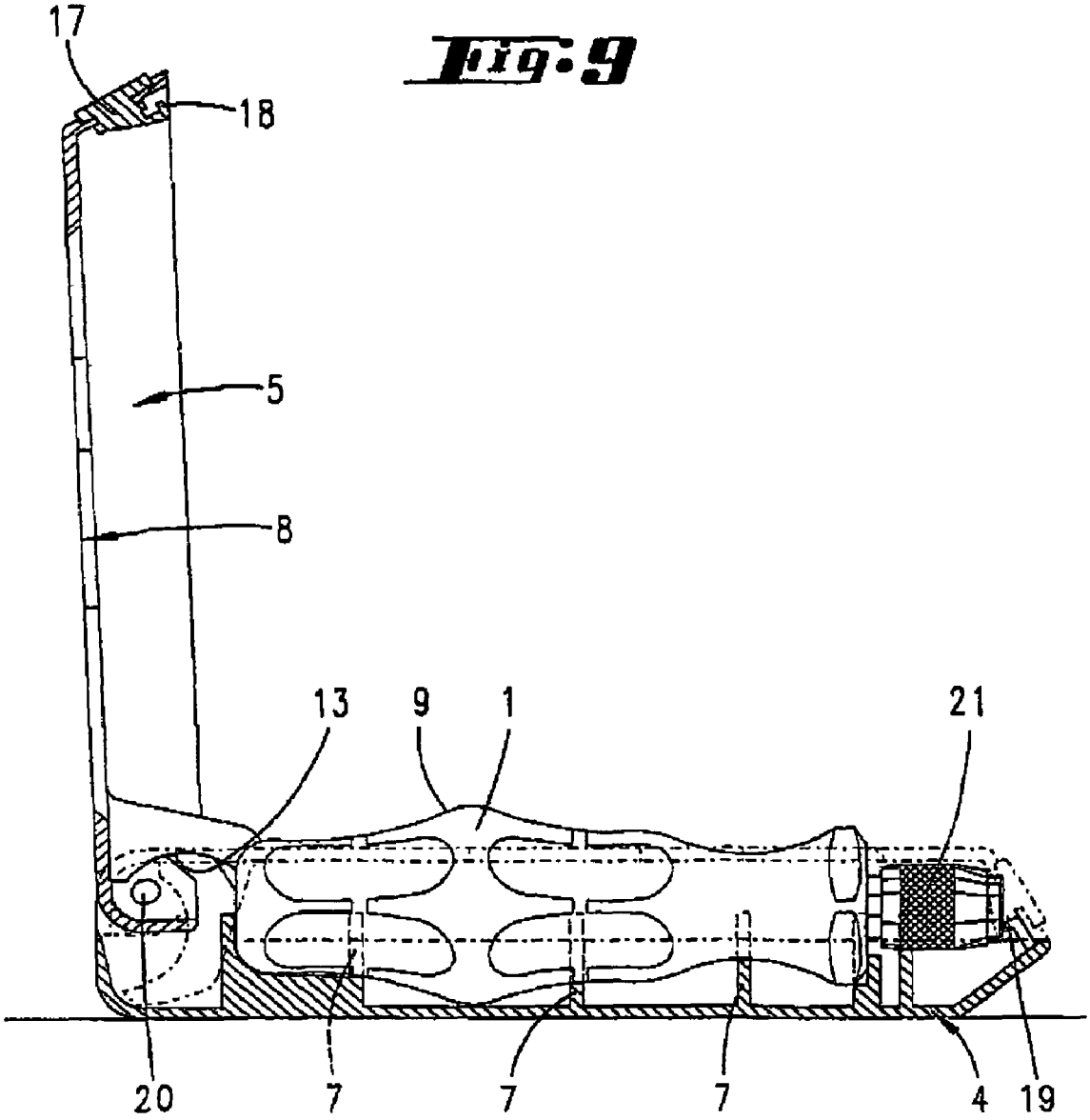
Figure 10:
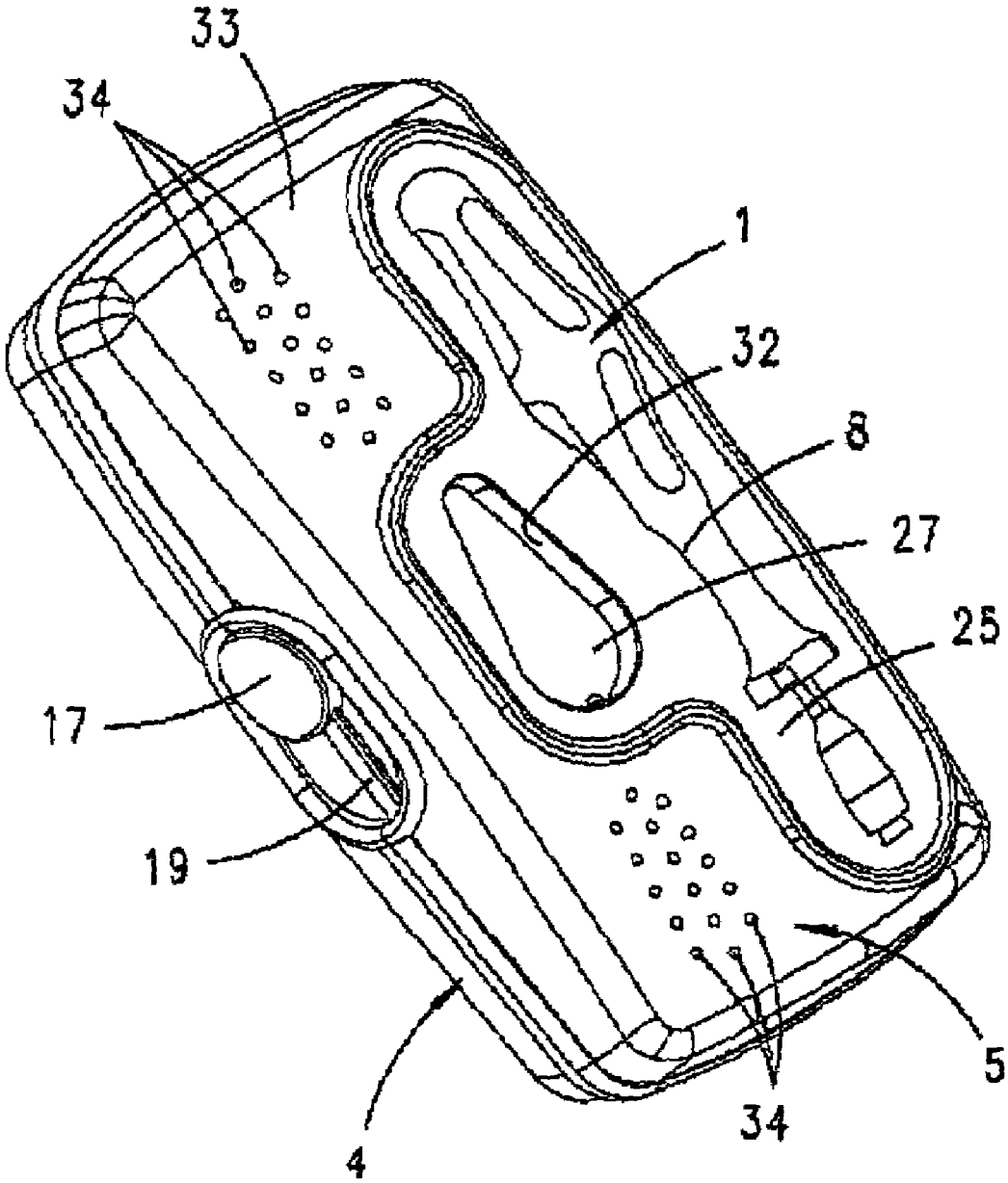
FIG. 10 shows the perspective view of a further exemplary embodiment of the invention.
Figure 11:
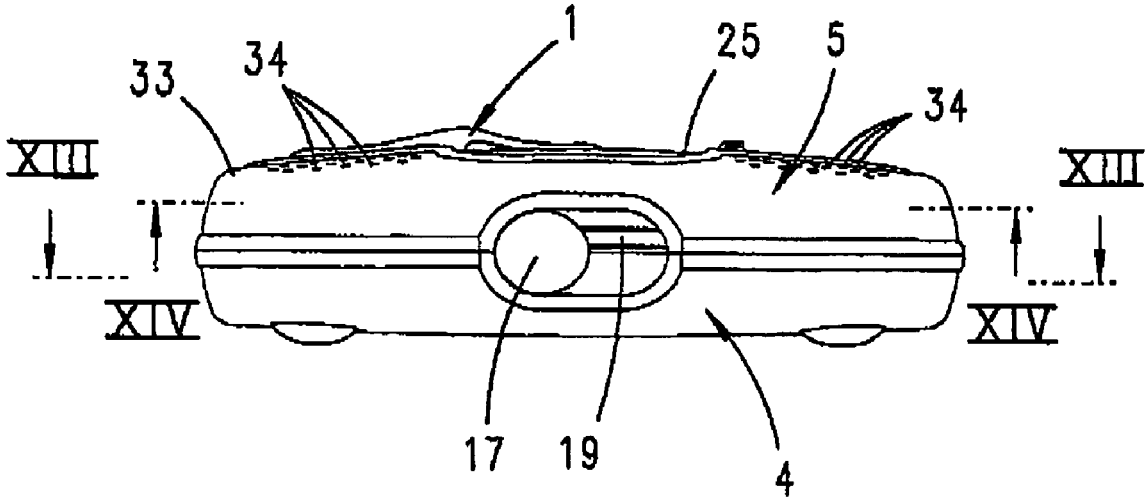
FIG. 11 shows a front view of the exemplary embodiment according to FIG. 10.
Figure 12:
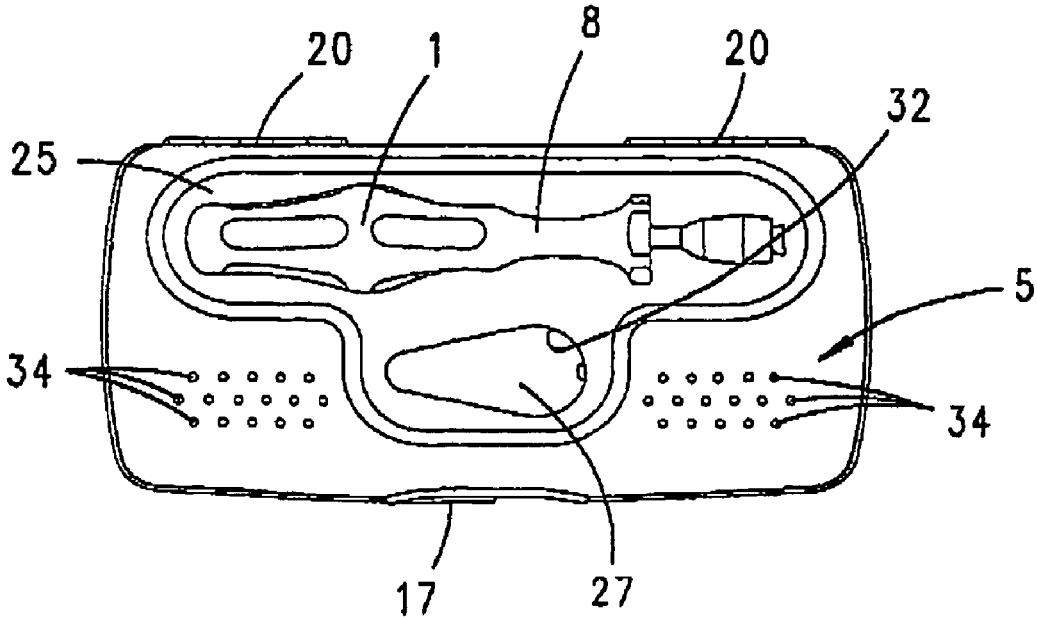
FIG. 12 shows a plan view of the exemplary embodiment according to FIG. 10.
Figure 13:
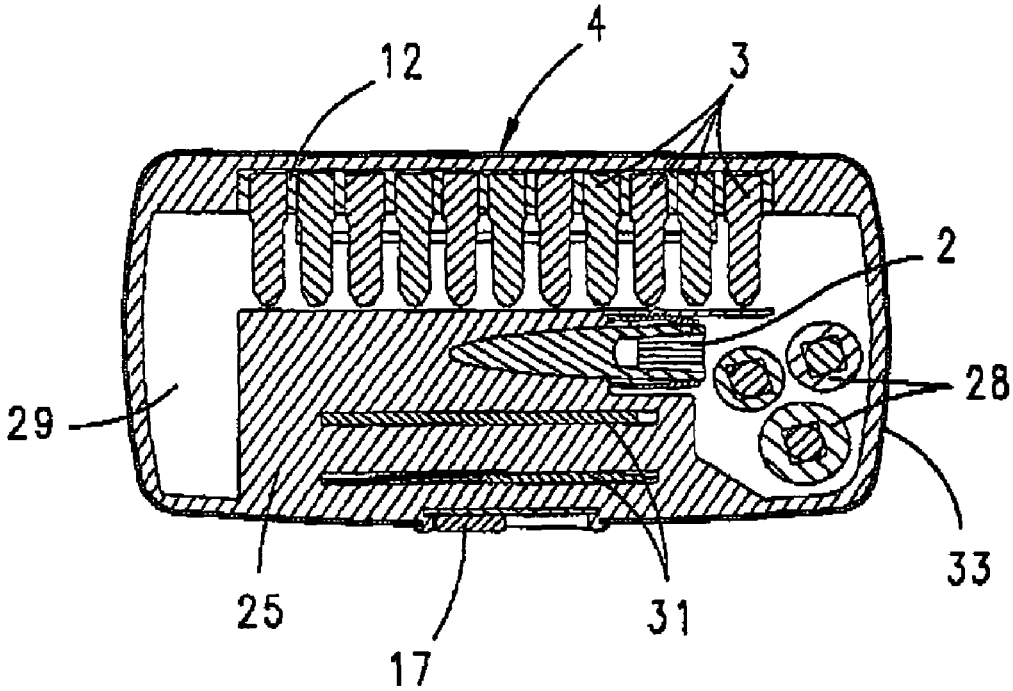
FIG. 13 shows a section along line XIII—XIII in FIG. 11.
Figure 14:
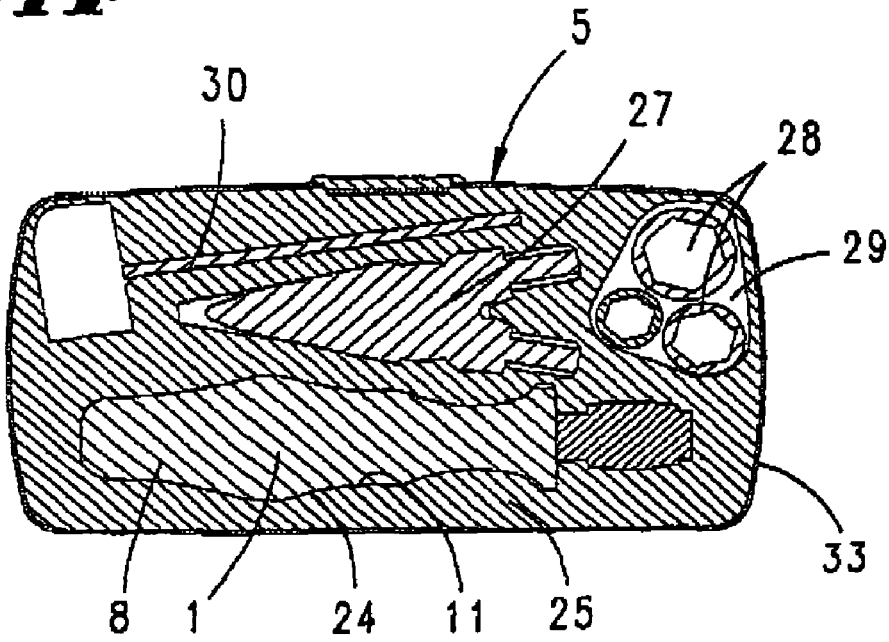
FIG. 14 shows a section along line XIV—XIV in FIG. 11.
Figure 15:
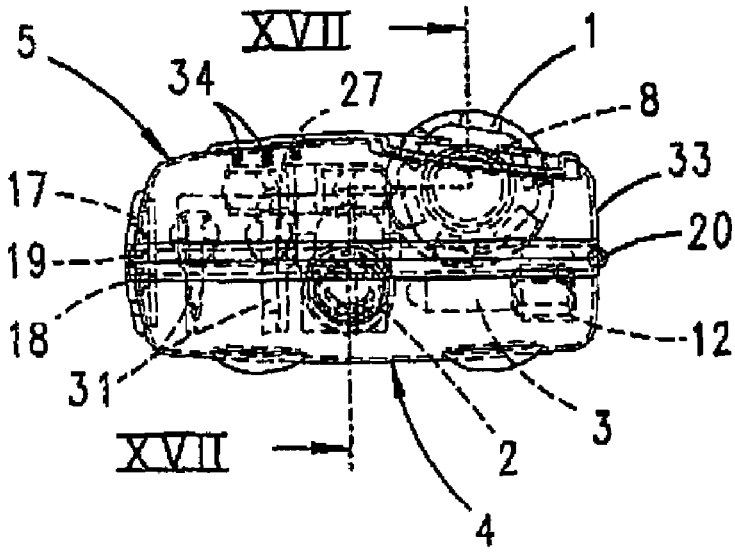
FIG. 15 shows a side view of the exemplary embodiment according to FIG. 10.
Figure 16:
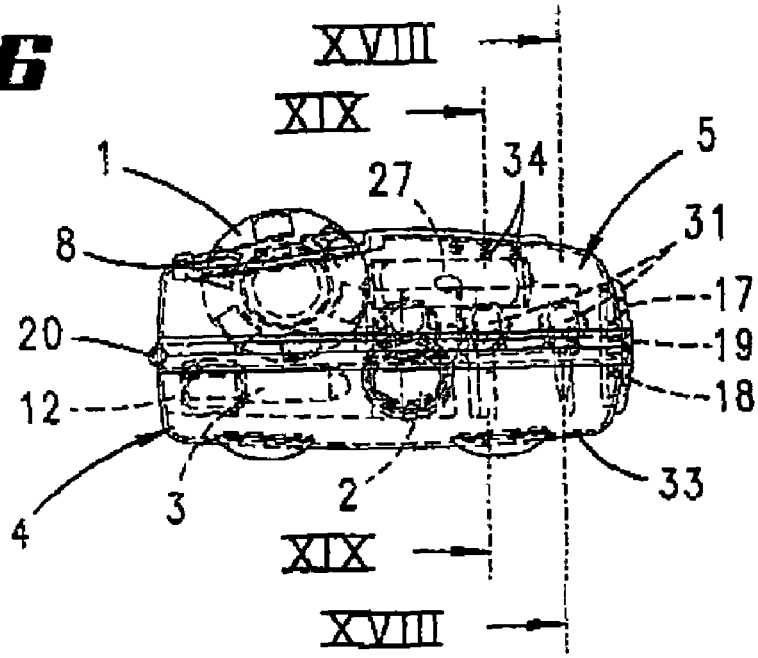
FIG. 16 shows a further side view of the exemplary embodiment according to FIG. 10.
Figure 17:
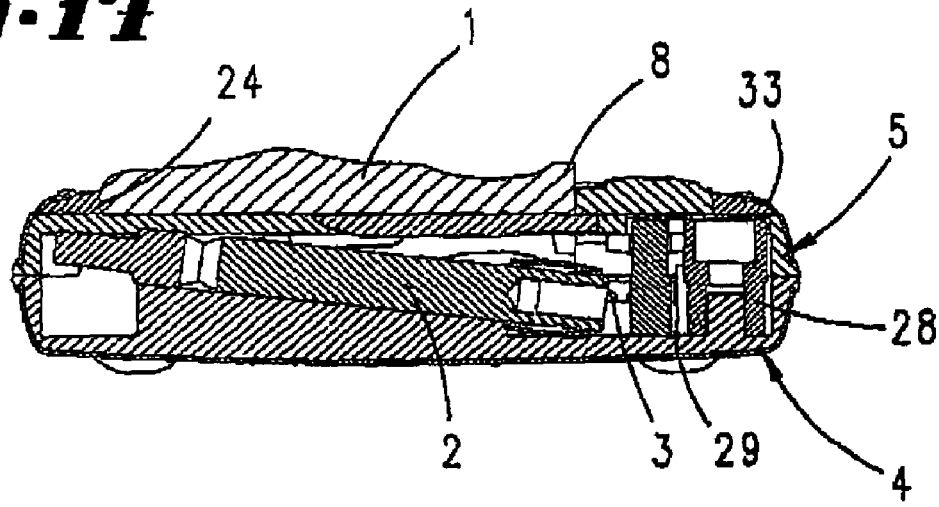
FIG. 17 shows a section along line XVII—XVII in FIG. 15.
Figure 18:
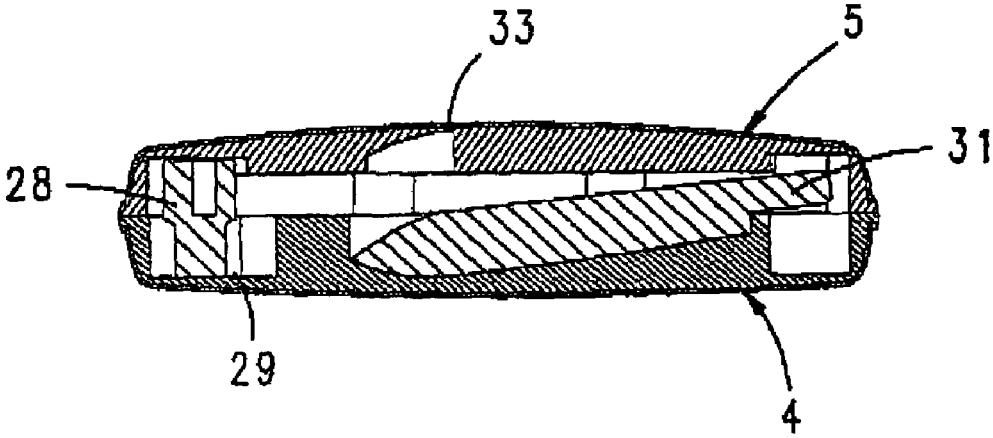
FIG. 18 shows a section along line XVIII—XVIII in FIG. 16.
Figure 19:
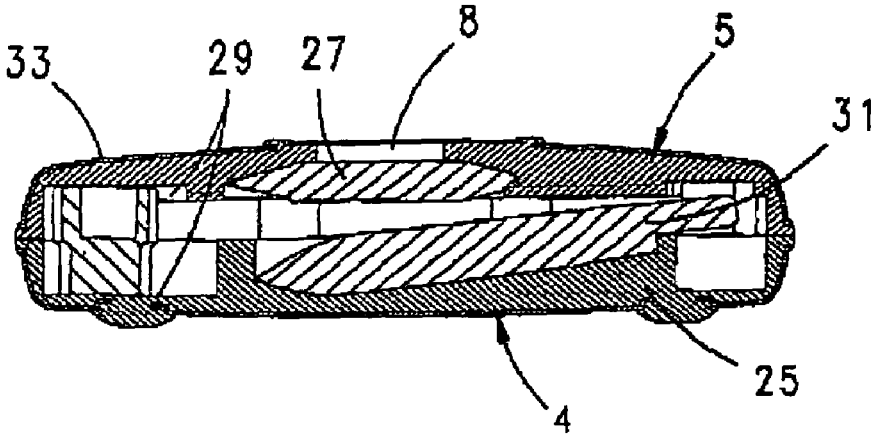
FIG. 19 shows a section along line XIX—XIX in FIG. 16.
Figure 21:
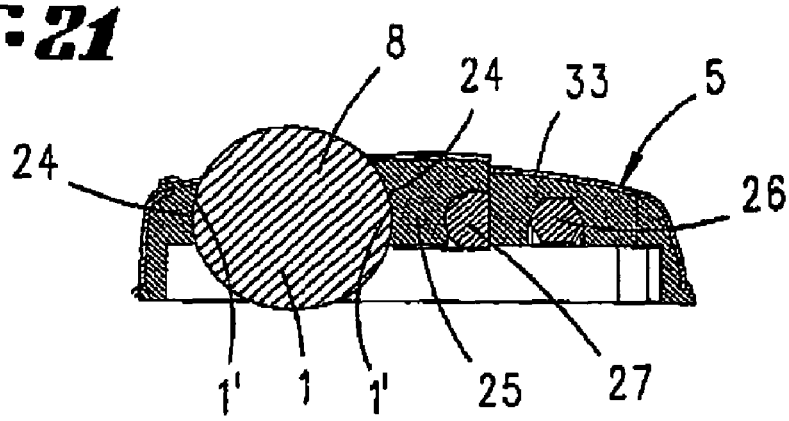
FIG. 21 shows a plan section along line XXI—XXI in FIG. 20.
Figure 20:
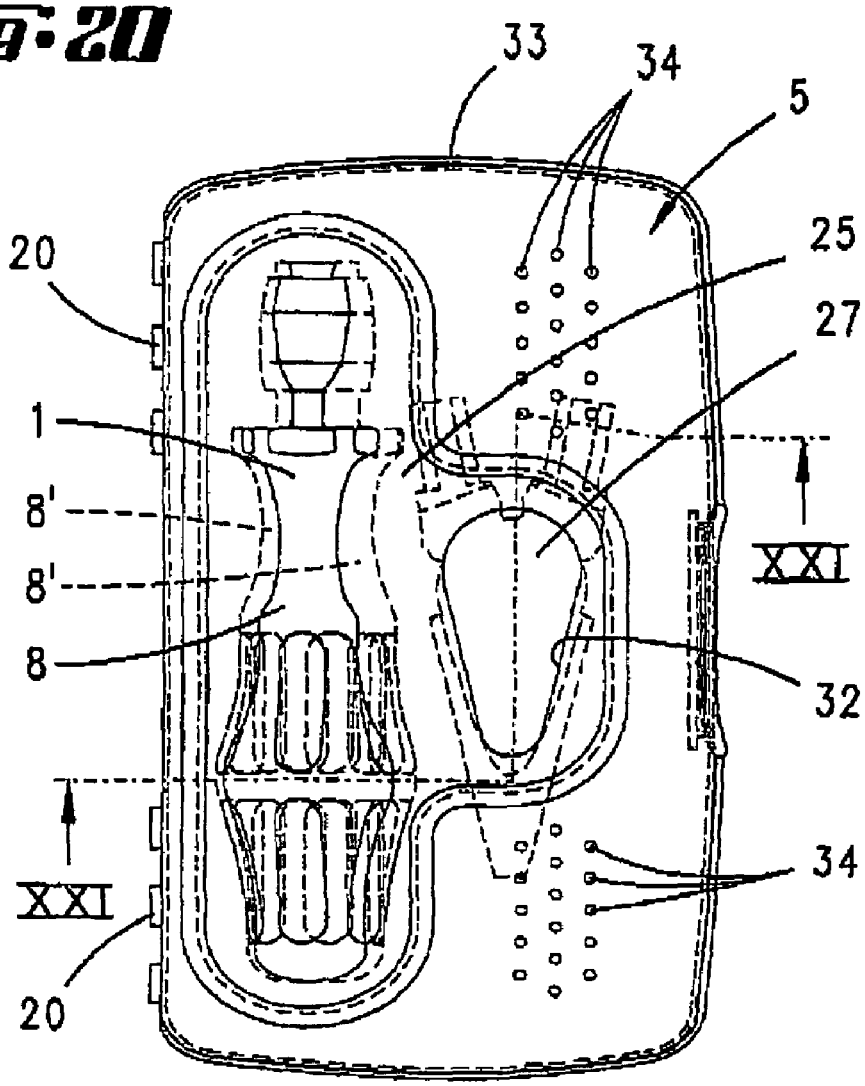
FIG. 20 shows a plan view according to FIG. 12, but with chain-dotted lines indicating the outline contour of the shell and the opening thereof and of the tools located in the storage device.
Figure 22:
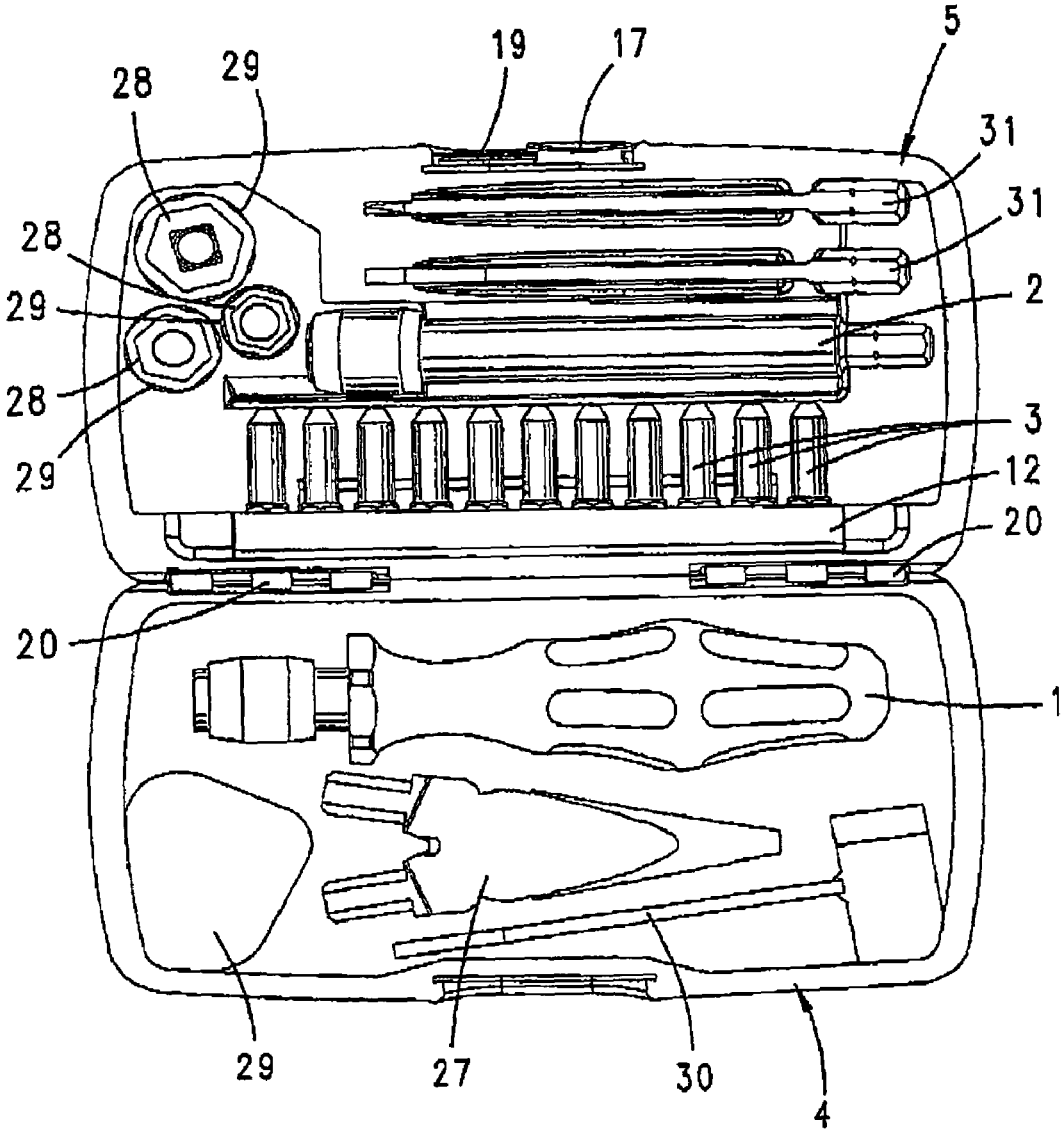
FIG. 22 shows an illustration of the exemplary embodiment according to FIG. 10 in the open position.
Figure 23:
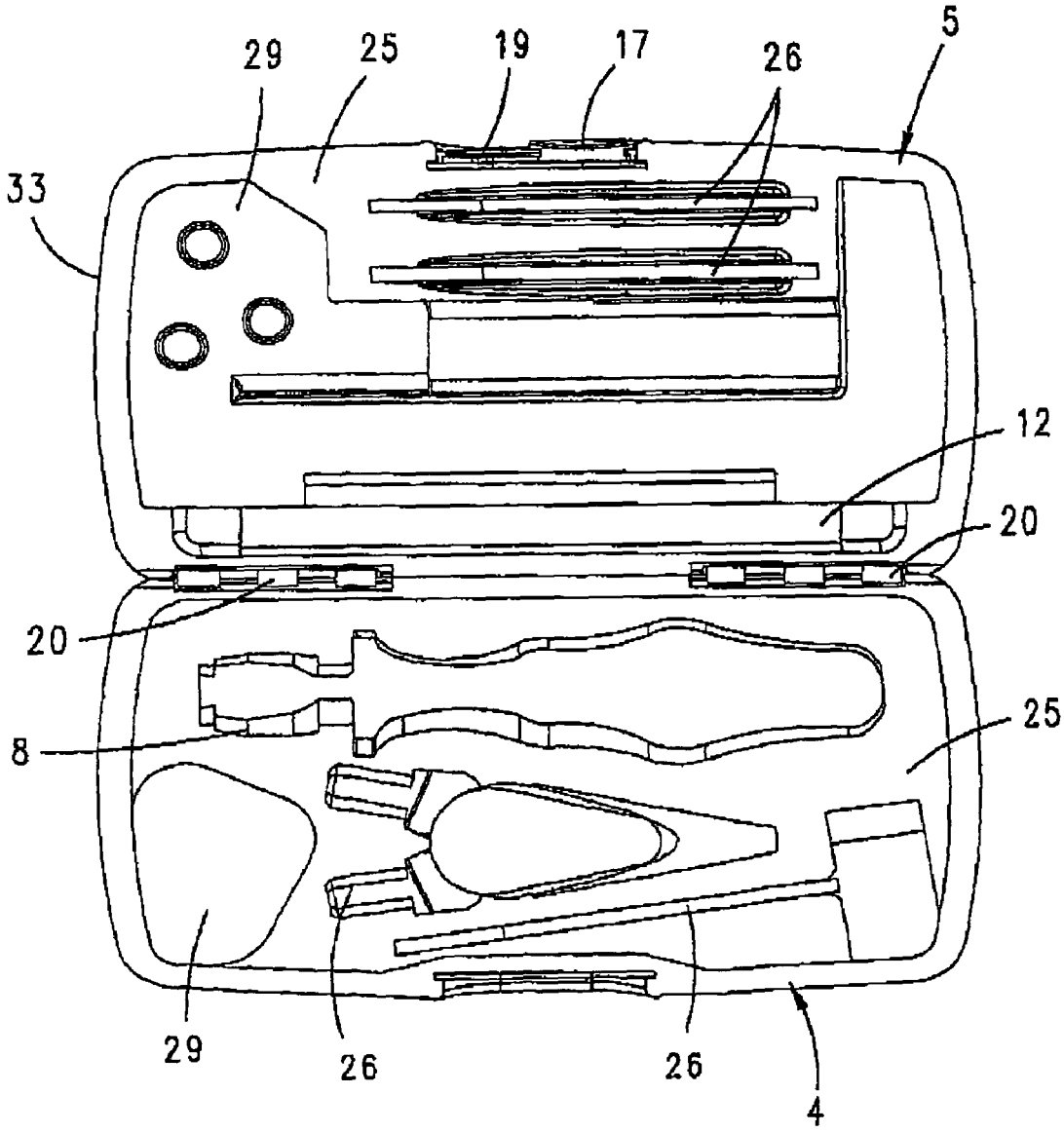
FIG. 23 is an illustration according to FIG. 22 without tools.

The exemplary embodiment illustrated in FIGS. 7 to 9 serves for accommodating a screwdriver handle 1 which has an insertion opening 21, for example in the form of a chuck, into which it is possible to insert either a screwdriver bit 3 or a chuck 2, by way of its polygonal portion 23.

Figure 2:
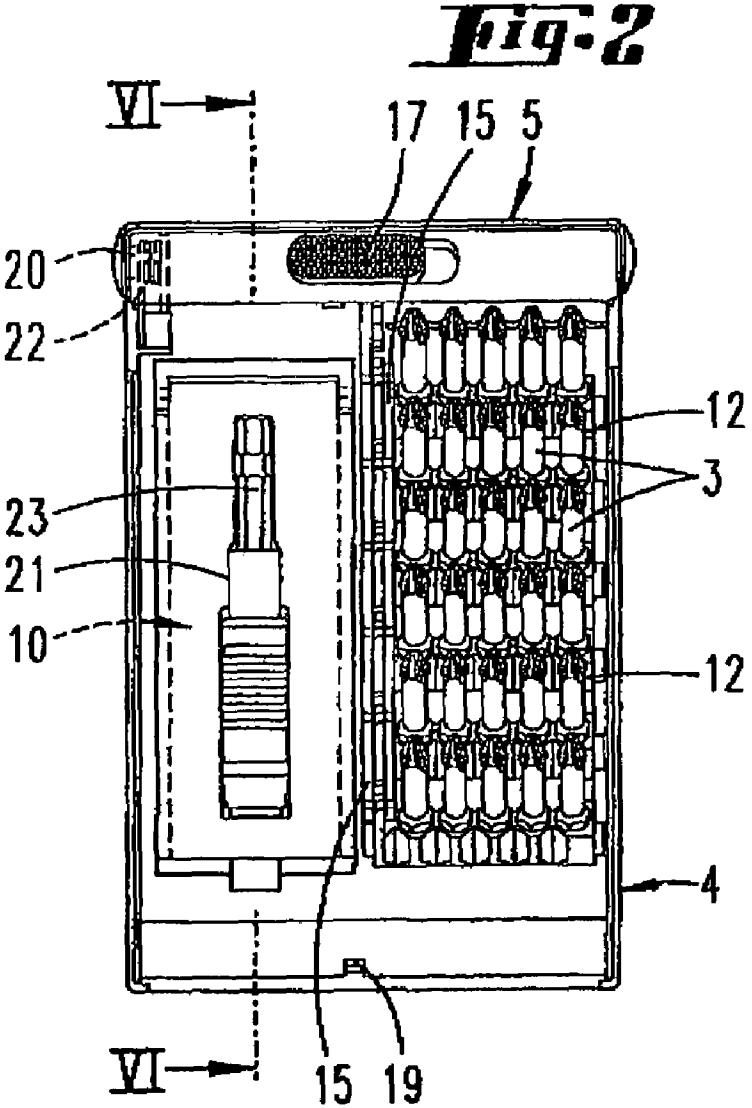
FIG. 2 shows an illustration according to FIG. 1 with the lid part open.
Figure 1:
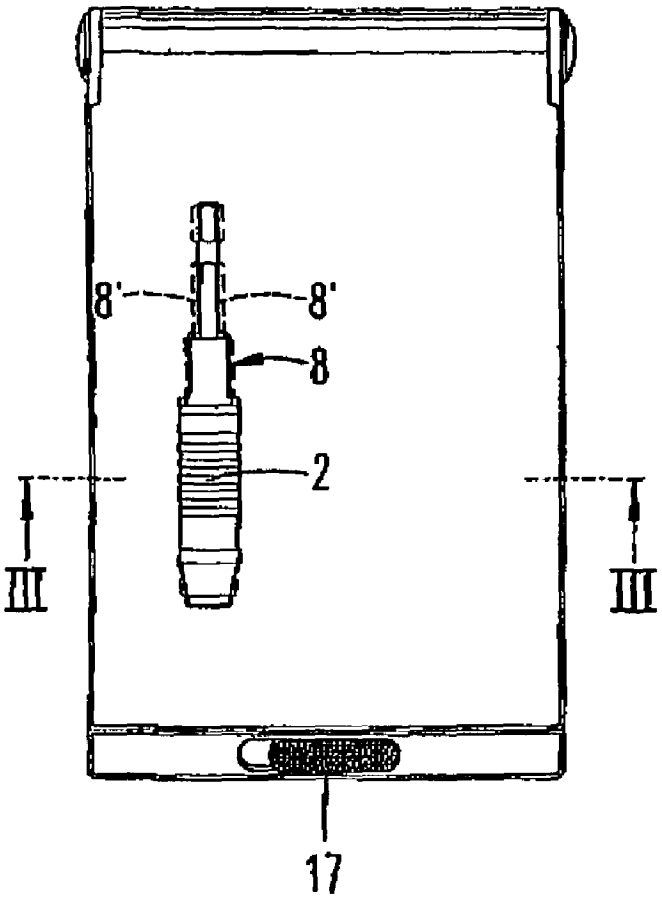
FIG. 1 shows a first exemplary embodiment of the invention in a plan view with the lid part closed.
Figure 3:
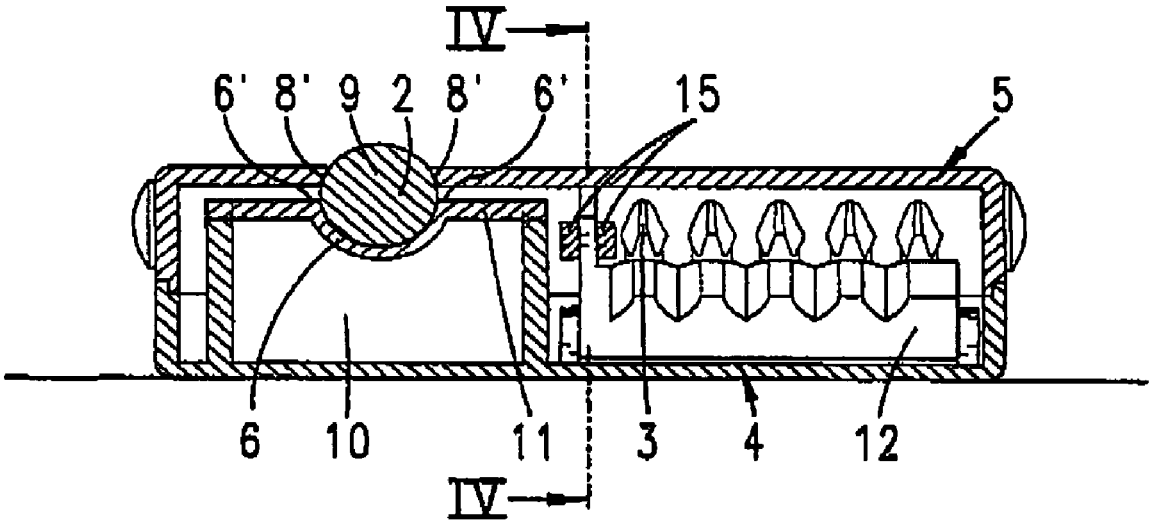
FIG. 3 shows a section along line III—III in FIG. 1.
Figure 6:
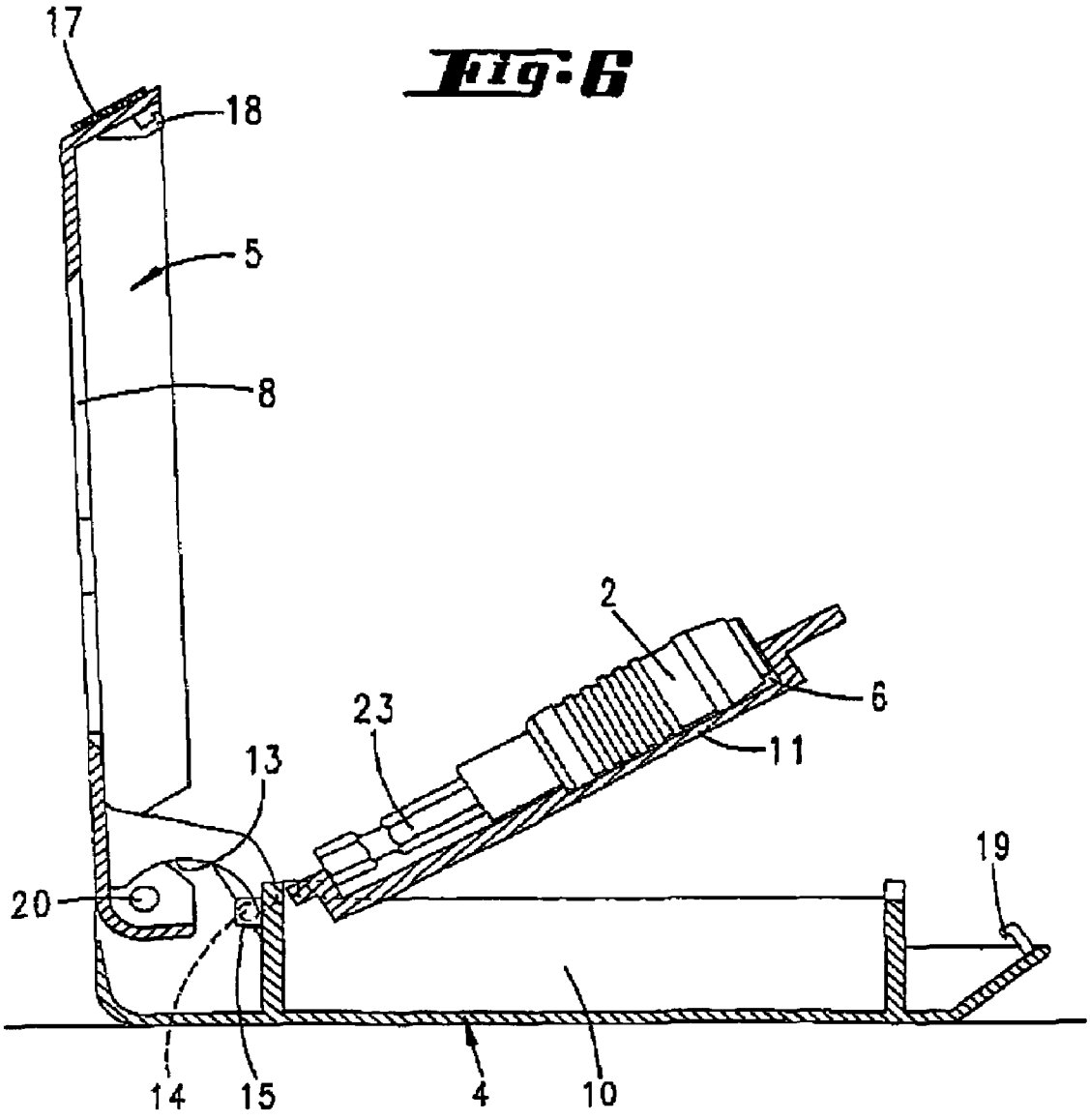
FIG. 6 shows a section along line VI—VI in FIG. 2.

The storage device according to the invention as it is illustrated in FIGS. 1 to 9 has a base part 4 which is a plastics injection molding. Assigned to the base part 4 is a likewise injection-molded lid part 5, by means of which the base part 4 can be closed. For this purpose, the lid part 5 is pivoted about a pivot pin 20. The spring 22, which is illustrated in FIGS. 2 and 8, forces the lid part 5 into the open position (FIGS. 5, 6 and 9). If the lid part 5 is displaced into the closed position (FIGS. 3 and 4), then the closure 17, in the form of a slide, has to be moved into the closed position. For this purpose, a hook 18 of the closure slide 17 grips over a protrusion 19. During closure, the hook 18 snaps over the protrusion 19.

A multiplicity of bars 12, which are oriented parallel to one another, are located in the base part 4. The bars 12 can be pivoted up in each case about a pivot pin. The pivot pin belonging to each bar runs parallel to the pivot pin 20 of the lid 5. The parallel bars 12 are connected to one another by means of a connecting rod 15. For this purpose, use is made of drive pins 16 which project laterally from the connecting rod 15 and each act on one bar 12. The bars each contain a multiplicity of openings, into which screwdriver bits can be inserted.

The free end of the connecting rod 15 has a drive pin 14. A helical cam 13, which is associated with a hook extension of the lid part 5, acts on this drive pin 14. The cam is disposed in the region of the pivot pin 20 and extends such that, as the lid part 5 is closed, the bars 12 which have been moved into an upright, removal position (FIG. 5) are moved into an oblique, storage position (FIG. 4).

The lid part 5 has a window-like cutout 8. The contour line of the peripheral edge 8' of the window 8 follows the contour line of the handle 1 or of the chuck 2. The spacing between two mutually opposite peripheral edges 8' is larger than the diameter of the substantially rotationally symmetrical screwdriver handle 1 or chuck 2 at the corresponding location. As a result, corresponding to the illustration in FIG. 3, the screwdriver handle 1 or the chuck 2 projects out of the window 8 in certain regions, by way of a projecting portion 9. Certain regions of the diameter of the handle may thus be larger than the overall height of the storage device, that is to say the spacing between the lid panel and the base panel. The length of the window 8 corresponds to the length of the article located therein, so that the end surfaces of this article are located in front of the narrow peripheries of the window 8.

In the case of the exemplary embodiment illustrated in FIGS. 1 to 6, the mount 6 in which the chuck 2 is located is configured as a tray. This tray is formed by a lid 11 of a chamber 10. The chamber lid 11 can be opened with the chuck 2 located in the tray 6. Once the lid 11 has been closed, and the lid part 5 is located in the closed position illustrated in FIG. 3, then it can be gathered that the peripheral edge 8' of the window 8 is in contact with the outer wall of the projecting portion 9 of the chuck 2. There is virtually no gap between the periphery 8' of the window 8 and the outer contour of the tool 1, 2. As can be seen from FIG. 3, there is also only a small gap between the lid 11 and the lid part 5, so that, even with the tool 2 removed, it is not possible for any foreign bodies to penetrate into the storage device or for any parts located in the latter to be lost through the window.

It is regarded as advantageous for the peripheral edge 8' to follow the outline contour of the tool 1, 2 located in the mount 6, since this ensures, for the most part, that only the associated tool is located in the mount 6. If an incorrect tool is located in the mount 6, this can be gathered from the fact that either the lid 5 cannot be closed or the peripheral edge 8' is not in gap-free contact with the outline contour of the tool 1, 2.

In the case of the exemplary embodiment illustrated in FIGS. 7 to 9, the mount is formed by a plurality of mutually parallel crosspieces 7 rather than by a tray. These crosspieces form cutouts which follow the outline contour of the handle 1. This results in the handle having multi-point contact in the downward direction and being held from above by the periphery 8' of the window 8 in the closed state of the accommodating device.

In the case of the exemplary embodiment illustrated in FIGS. 7 to 9, the storage device additionally accommodates a chuck 2, into which it is possible to insert the screwdriver bits 3 and which, in turn, can be inserted, by way of its polygonal portion 23, into the chuck 21 of the screwdriver handle 1. The lid grips over the chuck 21.

The exemplary embodiment illustrated in FIGS. 10 to 23 is an accommodating device for a screwdriver handle which has, at its blade end, a chuck into which it is possible to insert the blade-extension element which is designated 2 there, and is likewise provided with a chuck. The screwdriver handle 1 is located in a window 8. The reveal of the window 24 has a surface contour which follows the contour of the handle 1. The reveal 24 forms, in particular, a hollow fillet. Two approximately opposite portions 1' of the handle 1 are located with clamping action in the two undercuts formed by two mutually opposite hollow fillets. A further retaining cutout 26 is situated alongside the window 8, in which the screwdriver handle 1 is located. A pliers head 27 is located in this retaining cutout 26. The base of this retaining cutout 26 has a viewing window 32, the outline contour of which corresponds roughly to the outline contour of the pliers head 27. The pliers head, rather than having handle arms, has coupling end portions 35 onto which the handle 1 or the blade extension 2 can be plugged in order to form handle arms. Both the retaining cutout 26 and the window 8 are formed by a soft-plastics lining 25. The soft-plastics lining 25 lines a metal shell 33. The metal shell 33 has an approximately T-shaped opening which is fully lined with the soft-plastics lining 25, which forms the window 8 and/or the viewing window 32. Also located in the metal shell 33 are a multiplicity of grid-like openings through which portions of the soft-plastics lining project in order thus to form protuberances 34.

Both the lid part 5 and the base part 4 have a soft-plastics lining 25, which forms a multiplicity of compartments in which individual tools 1, 27, 31 and 28 are located. The tools are formed by knives 30 and/or files or rasps 31, which are likewise retained there with a clamping fit. Nuts or followers 28 are additionally inserted in accommodating chambers 29. Furthermore, a pivoting bar 12 is provided parallel to the hinge 20, the pivoting bar having accommodating openings for the insertion of screwdriver bits 3. All the tools are retained with a clamping fit such that the accommodating device can be swung open without the tools which are disposed in the interior of the lid part falling out of their retaining cutouts.

It is also possible for the tools which are located in the base part to be retained there with a clamping fit, so that even the act of upending the open accommodating device does not result in tools falling out. This safeguard, however, is basically only necessary for the lid part 5.

The task of removing the pliers head, the broad-side surface of which is aligned with the surface of the soft-plastics lining 25, is simplified by the viewing window 32. It is possible there to use a finger to apply pressure to the joint of the pliers head 27 in order to force the latter out of the clamping fit in its retaining cutout 26.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

The invention claimed is:

1. Storage device for at least one tool, wherein elements of the tool include a handle and a plurality of bits engageable by the handle, the storage device comprising: a base part (4) and a pivot-open lid part (5) articulated thereon, a mount (6, 7, 24) located on one of said base part or said lid part, said mount being provided for accommodating an element of the tool (1, 2) in a fixed position parallel to one of the base part or the lid part (5), wherein the lid part (5) has a window (8) which is similar to an outline contour of the tool element (1, 2), wherein peripheral-edge spacing of the window relative to the tool element is selected such that the tool element (1, 2) cannot be removed through the window (8) of said lid part (5) during closure of the lid part to the base part, wherein certain regions of the tool element (1, 2) project through the window (8) of the closed lid part (5), and wherein peripheral portions of the window are in contact with the tool element at two spaced-apart locations on the tool element during closure of the lid part to the base part, and a location for storage of the tool handle is displaced from a location of storage of said plurality of bits.

2. Storage device according to claim 1, wherein a first portion of the tool element projects through the window while a second portion of the tool element is contacted by the peripheral portions of the window.

3. Storage device according to claim 1, wherein the mount is a tray (6).

4. Storage device according to claim 3, wherein the lid part (5) rests on a tray periphery (6') or is spaced apart therefrom merely by a small gap.

5. Storage device according to claim 3, wherein the tray (6) is seated in a lid (11) of a chamber (10) associated with the base part.

6. Storage device according to claim 1, wherein the mount forms a multiplicity of crosspieces (7) which have cutouts following the outline contour of the tool element (1).

7. Storage device according to claim 1, wherein the lid part (5) is forced in opening direction by spring action.

8. Storage device according to claim 1, further comprising a plurality of bars (12) which are associated in a pivotable manner, parallel to one another, with the base part (4) and have insertion openings for tool bits (3).

9. Storage device according to claim 8, wherein the bars (12), which are coupled to one another for movement purposes, pivot from a removal position into a storage position as the lid part (5) closes.

10. Storage device according to claim 1, wherein the lid part (5) forms a hook-shaped cam (13) which interacts with a drive pin of a connecting rod.

11. Storage device according to claim 1, wherein the tool (1) is located with clamping fit in a mount (24) of the lid part (5).

12. Storage device according to claim 11, wherein the mount on the lid part forms an elastically compliant contour surface (24) which follows surface contour (1') of the tool (1) and has at least two mutually opposite clamping portions.

13. Storage device according to claim 12, wherein the contour surface (24) in formed by a soft plastic material walled reveal of the window (8).

14. Storage device according to claim 13, wherein the reveal is formed by a soft-plastic lining (25) of the lid part (5).

15. Storage device according to claim 1, wherein both the lid part (5) and the base part (4) have a soft-plastic lining (25), which have a multiplicity of retaining cutouts (26) in which tools (27, 30, 31) are secured with a clamping fit.

16. Storage device according to claim 1, wherein a head (27) of a pair of pliers is located in a retaining cutout (26) adjacent to the screwing tool (1).

17. Storage device according to claim 16, wherein a base of the retaining cutout (26) associated with the pliers bead (27) has a through-passage opening which forms a viewing window (32) and through which, in particular, a joint of the pliers head is visible.

18. Storage device according to claim 1, wherein a soft-plastic lining (25) extends through an opening of a metal shell (33) of the lid part (5) and forms a portion of an outside of the lid part to which the window (8) and/or through-passage opening (32) is associated.

19. Storage device according to claim 18, further comprising island-like extensions (34) of the soft-plastic lining (25) project through grid-like openings of the metal shell (33).

20. Storage device according to claim 1, wherein the tool is a screwdriver, said plurality of bits are screwdriver bits, said lid part is configured for receiving the handle of the screwdriver, and said base part is configured for receiving said screwdriver bits.

* * * * *